US008464703B2

(12) United States Patent
Ryu et al.

(10) Patent No.: US 8,464,703 B2
(45) Date of Patent: Jun. 18, 2013

(54) TOP-BURNER AND COOKER COMPRISING THE SAME

(75) Inventors: Jung-Wan Ryu, Changwan (KR); Dae-Bong Yang, Changwon (KR); Jae-Hyuk Wie, Changwon (KR); Yong-Ki Jeong, Changwon (KR); Jae-Bum Lim, Changwan (KR); Jun-Ho Seok, Changwon (KR); Young-Soo Kim, Changwon (KR); Yang-Ho Kim, Changwon (KR); Dae-Rae Lee, Changwan (KR)

(73) Assignee: LG Electronics Inc., Seoul (KR)

( * ) Notice: Subject to any disclaimer, the term of this patent is extended or adjusted under 35 U.S.C. 154(b) by 382 days.

(21) Appl. No.: 12/809,006

(22) PCT Filed: Dec. 17, 2008

(86) PCT No.: PCT/KR2008/007499

§ 371 (c)(1),
(2), (4) Date: Sep. 20, 2010

(87) PCT Pub. No.: WO2009/078673

PCT Pub. Date: Jun. 25, 2009

(65) Prior Publication Data

US 2011/0120444 A1 May 26, 2011

(30) Foreign Application Priority Data

Dec. 17, 2007 (KR) ..... 10-2007-0131865
Dec. 17, 2007 (KR) ..... 10-2007-0131867
Dec. 17, 2007 (KR) ..... 10-2007-0131868
Dec. 17, 2008 (KR) ..... 10-2008-0128488

(51) Int. Cl.
*F24C 3/00* (2006.01)

(52) U.S. Cl.
USPC ..... 126/39 E; 126/39 R; 431/278; 431/350; 431/354

(58) Field of Classification Search
USPC ..... 126/39 E, 39 R; 431/278, 283, 285, 431/286, 350, 354
See application file for complete search history.

(56) References Cited

U.S. PATENT DOCUMENTS 6,945,774 B2 * 9/2005 Shoeb ..... 431/354

FOREIGN PATENT DOCUMENTS

| | | | |
|---|---|---|---|
| JP | 63-173629 | U | 11/1988 |
| KR | 10-1999-0001978 | A | 1/1999 |
| KR | 10-1999-0031386 | A | 5/1999 |
| KR | 20-1999-0014909 | U | 5/1999 |
| KR | 10-0682664 | B1 | 2/2007 |

* cited by examiner

*Primary Examiner* — Alfred Basichas
(74) *Attorney, Agent, or Firm* — Birch, Stewart, Kolasch & Birch, LLP

(57) ABSTRACT

A top burner and a cooker having the top burner are provided. A flame transfer slit for guiding the flame formed by the combustion of the mixed gas at an outer burner to an inner burner. A shielding member is provided to shield the flame transfer slit. Therefore, the object to be heated is uniformly heated and the flame transfer from the outer burner to the inner burner can be effectively realized.

23 Claims, 4 Drawing Sheets

TOP-BURNER AND COOKER COMPRISING THE SAME

TECHNICAL FIELD

The present disclosure relates to a cooker, and more particularly, to a top burner for cooking food by combusting gas and a cooker having the top burner.

BACKGROUND ART

A cooker is a home appliance that cooks food using gas or electric power. For the cooker using the gas, the cooker has a burner that cooks the food by heating a container containing the food by combusting the gas. The burner includes a burner main body supplying gas, a burner head coupled to an upper end of the burner main body, a burner cap forming a flame hole through which the gas jets out, and an ignition plug igniting the gas jetted out through the flame hole.

DISCLOSURE OF INVENTION

Technical Problem

Embodiments provide a top burner that is designed to evenly heat an entire portion of food and a cooker having the top burner.

Embodiments also provide a top burner that is designed to effectively transfer fire between outer and inner burners and a cooker having the top burner.

Embodiments also provide a top burner that is designed to prevent combustion of flame, which may be caused by fire transfer between outer and inner burners by food and a cooker having the top burner.

Embodiments also provide a top burner that is designed to reduce imperfect combustion of mixed gas and a cooker having the top burner.

Technical Solution

In an embodiment, a top burner includes: a first burner provided with a plurality of flame holes that form flame by combusting mixed gas; a second burner provided with a plurality of flame holes that form flame separated from the flame formed by the flame holes of the first burner by combusting the mixed gas; and a flame transfer slit transferring the flame formed through the flame holes of the first burner to the second flame holes of the second burner.

In another embodiment, a top burner includes: an outer burner installed on a top surface of a top plate and provided at an edge thereof with a plurality of flame holes that form flame by combusting mixed gas; an inner burner installed on a top surface of the outer burner and provided at an edge located at an inside of the edge of the outer burner with a plurality of flame holes that form flame by combusting the mixed gas; and a flame transfer slit that is provided on the outer burner to transfer the flame formed through the flame holes of the outer burner to the second flame holes of the inner burner.

In still another embodiment, a cooker includes: a top plate defining an exterior of a top portion thereof; a top grid provided on the top plate to support an object to be heated; the top burner according to any one of claims 1 to 25; and an oven unit provided under the top burner.

Advantageous Effects

According to the embodiments, a bottom of the object to be heated is uniformly heated by the burner and the fire transfer between the outer and inner burners can be effectively realized. In addition, the imperfect combustion of the mixed gas can be reduced.

Figure 1:
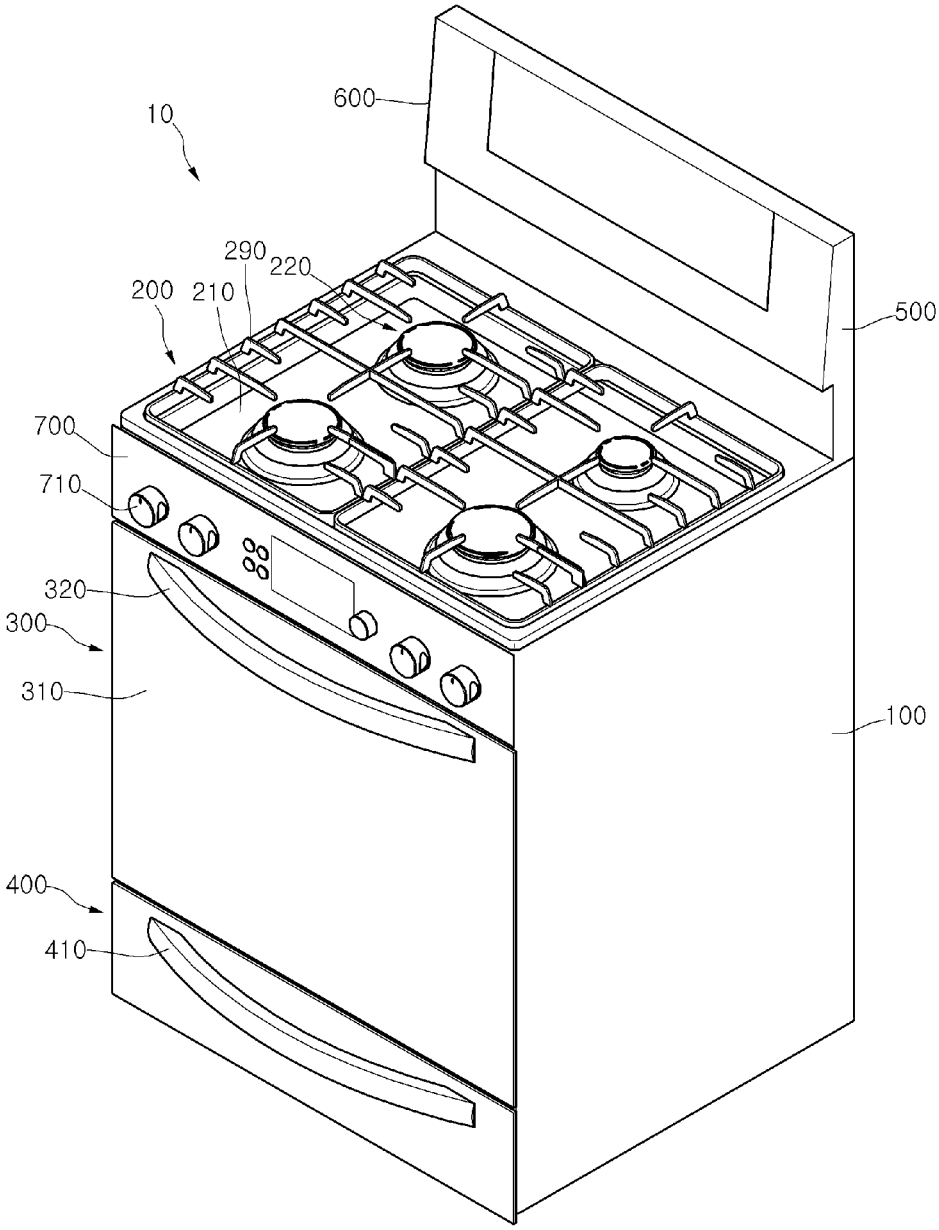
FIG. 1 is a perspective view of a cooker having a top burner according to a first embodiment.

BEST MODE FOR CARRYING OUT THE INVENTION function to heat the container containing the food by combusting the gas. The top burners 220 will be described in more detail later.

In addition, the top burner unit 200 includes a plurality of top grids 290. The container that will be heated by the top burner 220 is disposed on the top grids 290.

Meanwhile, the oven unit 300 is provided at a central portion of the main body 100 under the top burner unit 200. An oven chamber (not shown) in which the food is cooked is defined in the oven unit 300. The oven is selectively opened and closed by a door 310. The door 310 selectively opens and closes the oven chamber as an upper end of the door 310 pivots about a lower end of the door 310. A door handle 320 is provided on a front-upper end of the door 310. A user grasps the door handle 320 and opens and closes the door 310.

Further, the warming drawer 400 is provided on a lower end of the main body 100 under the oven unit 300. The warming drawer 400 is installed to be drawn in and out of the main body. The container containing the food is disposed on the warming drawer 400 and the container disposed on the warming drawer 400 is heated by a heater for cooking the food or a separate heater for warming. A drawer handle 410 is provided on a front surface of the warming drawer 400. The user grasps the drawer handle 410 and draws in and out the warming drawer 400.

The back guard 500 is provided on a top-rear end of the main body 100 behind the top burner unit 200. The back guard 500 extends upward from the top of the main body 100. A fluid passage communicating with the oven chamber is provided in the back guard 500. Therefore, the combustion gas that is generated during the cooking of the food in the oven unit 300 (i.e., the oven chamber) is discharged out of the oven unit 300 through the fluid passage.

The control panel 600 is provided on the front surface of the back guard 500. The control panel 600 includes an input unit receiving a variety of manipulation signals for operating the oven unit 300 or the warming drawer 400 and a display unit for displaying a variety of information related to the operation of the oven unit 300 and the warming drawer 400.

Further, the top burner control unit 700 includes a plurality of manipulation knobs 710, the number of which corresponds to the number of the top burners 220. The manipulation knobs 710 selectively open and close valves (not shown) for supplying gas to the top burners 220.

An exterior of the top of the top burner unit 200 is defined by a top plate 210. The top plate 210 is provided with a burner installing portion 211 on which the top burners 220 are installed. The burner installing portion 211 protrudes upward such that a portion of the top plate 210 has a circular cross-section. Therefore, a top of the burner installing portion 211 is substantially located to be relatively higher than a top of the top plate 210.

Figure 2:
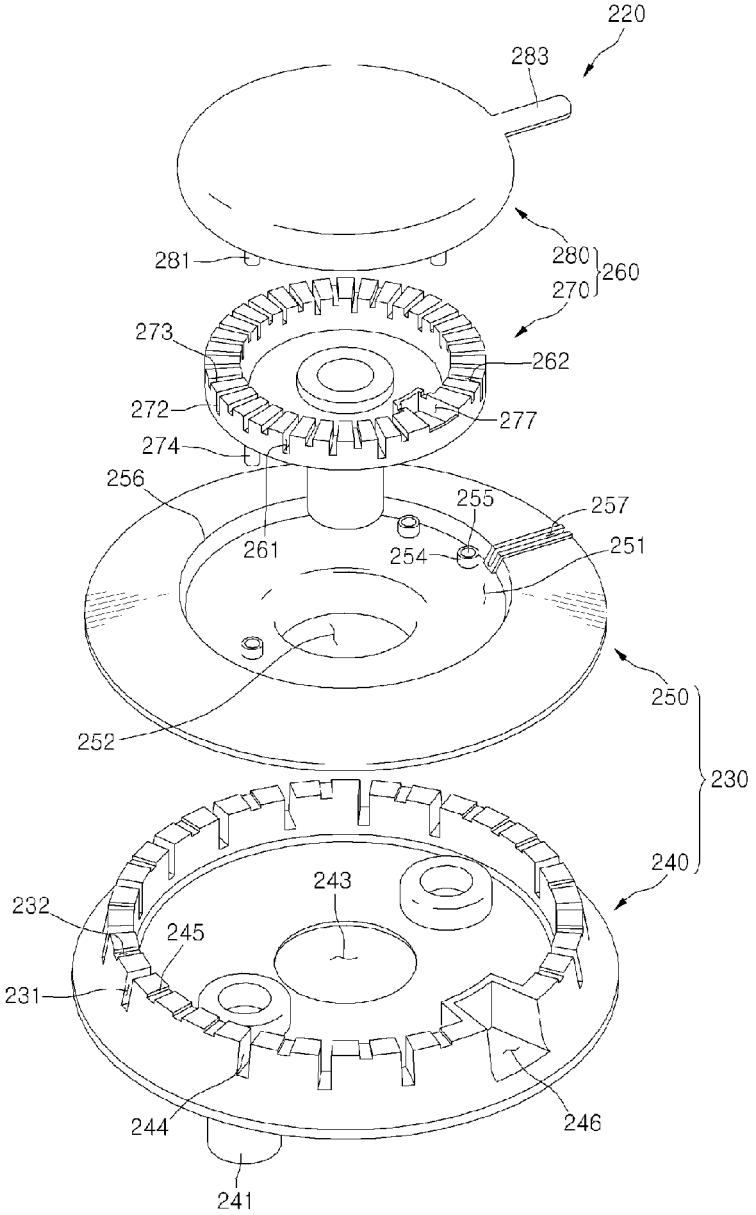
FIG. 2 is an exploded perspective view of the first embodiment.
Figure 3:
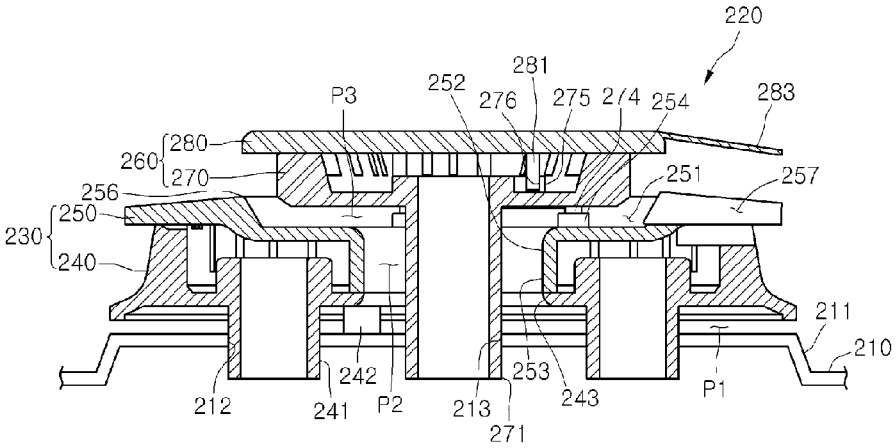
FIG. 3 is a side cross-sectional view of the first embodiment.

Referring to FIGS. 2 and 3, the top plate 210 is provided with first and second insertion holes 212 and 213. First and second mixing tubes 241 and 271 to be described later are respectively inserted into the first and second insertion holes 212 and 213 of the top plate 210. The first and second insertion holes 212 and 213 of the top plate 210 are formed by partly cutting the burner installing portion 211.

The top burner 220 includes an outer burner 230 and an inner burner 260. The outer and inner burners 230 and 260 are selectively operated in accordance with a cooking mode. In this embodiment, in a simmer mode for heating the food at a relatively low temperature, only the outer burner 230 is used. In a normal cooking mode, the outer burner 230 and/or the inner burner 260 are used. Further, the outer burner 230 includes an outer burner head 240 and an outer burner cap 250. The inner burner 260 includes an inner burner head 270 and an inner burner cap 280. Meanwhile, the outer burner head 240, outer burner cap 250, inner burner head 270, and inner burner cap 280 are formed of metal such as aluminum through a casting process.

The outer burner head 240 is formed to have an approximately circular cross-section. The outer burner head 240 is installed on a top surface of the burner installing portion 211.

The outer burner head 240 is provided with two first gas mixing tubes 241. The first gas mixing tubes 241 are for supplying gas mixed with air (hereinafter, referred to as mixed gas) that is injected through nozzles (not shown) provided in the top burner unit 200 under the top plate 210. Upper ends of the first gas mixing tubes 241 extend upward from the top of the outer burner head 240. Further, lower ends of the first gas mixing tubes 241 extend downward from an undersurface of the outer burner head 240 and inserted into the first insertion holes 212 of the top plate 210.

Three supporting protrusions 242 are provided on the undersurface of the outer burner head 240. The supporting protrusions 242 function to support the outer burner head 240 on the top of the to burner installing portion 211. Accordingly, the undersurface of the outer burner head 240 is spaced apart from the top surface of the burner installing portion 211 by a height of the supporting protrusions 242.

The outer burner head 240 is provided at a center thereof with an opening 243 through which the second gas mixing tube 271 passes. At this point, the opening 243 of the outer burner head 240 has a greater diameter than the second gas mixing tube 271. That is, an inner circumference of the opening 243 of the outer burner head 240 is spaced apart from an outer circumference of the second gas mixing tube 271.

A plurality of main flame hole forming teeth 244 and a plurality of sub-flame hole forming teeth 245 are provided on an inner circumference of a top surface of the outer burner head 240. The main and sub-flame hole forming teeth 244 and 245 are respectively for forming main flame holes 231 and sub-flame holes 232 of the outer burner 230. The main flame hole forming teeth 244 of the outer burner head 240 are relatively longer in a vertical direction than the sub-flame hole forming teeth 245 of the outer burner head 240.

An ignition portion 246 is formed on a portion of an outer circumference of the top surface of the outer burner head 240. The ignition portion 246 is a portion where an end portion of an ignition plug (not shown) is disposed. That is, the main and subflame holes 231 and 232 are first ignited spark generated by the ignition plug and the flame is propagated to entirely ignite the mixed gas discharged through the main and sub-flame holes 231 and 232 of the outer burner 230.

The outer burner cap 250 is disposed on the top surface of the outer burner head 240. The outer burner cap 250 is formed in a corresponding circular plate shape to the outer burner head 240. An outer circumference of an undersurface of the outer burner cap 250 forms the main and sub-flame holes 231 and 232 together with the main and sub flame hole forming teeth 244 and 245 of the outer burner head 240.

An inner burner seating portion 251 is formed on the top surface of the outer burner cap 250. The inner burner seating portion 251 is formed by grooving a central portion of the burner cap 250 downward. At this point, the inner burner seating portion 251 is formed in a circular shape having a co-center with the outer burner cap 250.

An opening 252 is formed on the outer burner cap 250. Like the opening 243 of the outer burner head 240, the second mixing tube 271 is a hole through which the second gas mixing tube 271 passes. The opening 252 of the outer burner cap 250 may be formed by partly cutting the inner burner seating portion 251.

A supporting rib 253 is provided on the outer burner cap 250. The supporting rib 253 is for supporting the outer burner cap 250 on the top surface of the outer burner head 250. The supporting rib 253 extends downward from the undersurface of the outer burner cap 250 corresponding to the inner circumference of the opening 252 of the outer burner cap 250, i.e., from the undersurface of the inner burner seating portion 251. The supporting rib 253 is supported on the top surface of the outer burner head 240 corresponding to the inner circumference of the opening 243 of the outer burner head 240.

Meanwhile, fixing bosses 254 are provided on the outer burner cap 250. The fixing bosses 254 of the outer burner cap 250 are for fixing the outer burner cap 250 and the inner burner head 270. Two fixing bosses 254 of the outer burner cap 250 are provided on the top surface of the inner burner seating portion 251. A fixing hole 255 is formed in the fixing bosses 254 of the outer burner cap 250. The fixing holes 255 of the outer burner cap 250 are portions in which fixing protrusions 274 of an inner burner head 270 to be described later are inserted.

Meanwhile, an inflow preventing step 256 is provided on the top surface of the outer burner cap 250. The inflow preventing step 256 prevents soup overflowing during the cooking from being introduced through the opening 243 of the outer burner head 240. In this embodiment, the inflow preventing step 256 is formed extending upward by a predetermined height at a boundary between the outer burner head 240 except for the inner burner seating portion 251 and the inner burner seating portion 251.

Further, the outer burner cap 250 is provided with a flame transferring slit 257 for transferring the flame generated by the combustion of the mixed gas through the main and sub-flame holes 231 and 232 of the outer burner 230 to the flame holes 261 of the inner burner 260. The flame transferring slit 257 is substantially formed by partly cutting a top surface of the outer burner cap 250 in a radial direction.

Meanwhile, the inner burner head 270 is disposed on the outer burner cap 250, substantially on the inner burner seating portion 251. The inner burner head 270 has a corresponding circular cross-section to the inner burner seating portion 251.

One second mixing tube 271 is provided on the inner burner head 270. The second mixing tube 271 is for supplying the mixed gas to the inner burner 260. An upper end of the second mixing tube 271 extends upward from the top surface of the inner burner head 270. A lower end of the second mixing tube 271 extends downward from the undersurface of the inner burner head 270 and inserted into the second insertion hole 213 through the opening 252 of the outer burner cap 250 and the opening 243 of the outer burner head 240.

A plurality of main flame hole forming teeth 272 and a plurality of sub-flame hole forming teeth 273 are provided on an inner circumference of a top surface of the inner burner head 270. The main and sub-flame hole forming teeth 272 and 272 are respectively for forming main flame holes 261 and sub-flame holes 262 of the outer burner 230.

Three supporting protrusions 274 are provided on the undersurface of the inner burner head 270. The supporting protrusions 274 function to support the outer burner cap 250 and the inner burner head 270. In a state where the inner burner head 270 is disposed on the top surface of the outer burner cap 250, the fixing protrusions 274 of the inner burner head 270 are inserted into the fixing holes 255 of the outer burner cap 250.

In addition, in a state where the fixing protrusions 274 of the inner burner head 270 are inserted into the fixing holes 255 of the outer burner cap 250, the undersurface of the inner burner head 270 seats on the top surfaces of the fixing bosses 254 of the outer burner cap 250. Accordingly, the top surface of the outer burner cap 250 is spaced apart from the undersurface of the inner burner head 270 by a predetermined distance.

Three fixing bosses 275 are provided on the top surface of the inner burner head 270. The fixing bosses 275 of the inner burner head 270 are respectively provided with fixing holes 276. The fixing bosses 275 and fixing holes 276 of the inner burner head 270 are for fixing the inner burner head 270 and the inner burner cap 280.

Further, the inner burner head 270 is provided with a gas chamber 276. The gas chamber 276 stores the mixed gas for re-ignition when the flame is extinguished in the main and sub-flame holes 261 and 162 of the inner burner 260.

The inner burner cap 280 is supported on the top surface of the inner burner head 270. The main and sub-flame holes 261 and 262 of the inner burner 260 are formed between the inner circumference of the undersurface of the inner burner cap 280 and the main and sub-flame hole forming teeth 273 and 273 of the inner burner head 270. Further, in a state where the inner burner cap 280 is supported on the top surface of the inner burner head 270, the undersurface of the inner burner cap 280 is spaced apart from the upper end of the second mixing tube 271 by a predetermined distance.

Three fixing protrusions 281 are provided on the undersurface of the inner burner cap 280. The fixing protrusions 281 of the inner burner cap 280 extend downward from the undersurface of the inner burner cap 280 and are inserted into the fixing holes 276 of the inner burner head 270 in a state where the inner burner cap 280 is disposed on the top surface of the inner burner head 270.

In addition, a shielding rib 283 is provided on the inner burner cap 280. The shielding rib 283 prevents the soup of the object to be heated from being introduced through the flame transfer slit 257. To achieve this, the shielding rib 283 substantially extends in a radial direction from an outer circumference of the inner burner head 270 and is located right above the flame transfer slit 257.

Meanwhile, there are provided fluid passages along which air is additionally supplied to the inner burner 260 to combust the mixed gas in the main and sub-flame holes 261 and 262 of the inner burner 260. The fluid passages include first, second, and third fluid passages P1, P2, and P3. The first fluid passage P1 is defined between the top surface of the burner installing portion 211 and the undersurface of the outer burner head 240. The second fluid passage P2 is defined between the outer circumferential surface of the second mixing tube 271 and the inner surface of the supporting rib 253. The third fluid passage P3 is formed between the top surface of the outer burner cap 250 and the undersurface of the inner burner head 270. In more detail, the air introduced through the first fluid passage P1 is supplied to the inner burner, i.e., to the main and sub-flame holes 261 and 262 of the inner burner 260 via the second and third fluid passages P2 and P3.

The following will describe the operation of the first embodiment of the top burner and the cooker having the top burner.

First, in the simmer mode, only the outer burner 230 is used to cook the food. In more detail, when the user manipulates the manipulation knob 710, the mixed gas is supplied to the outer burner 230 through the first mixing tube 241 and is discharged through the flame holes 231 of the outer burner 230.

In this state, the mixed gas discharged through the flame holes 231 is ignited by spark generated by the operation of the ignition plug in accordance with the manipulation of the user. Accordingly, the container disposed on the top grid 290 is heated by the flame formed by the combustion of the mixed gas discharged through the flame hole 231 of the outer burner 230.

Meanwhile, in the normal cooking mode, both the outer and inner burners 230 and 260 are used. In more detail, as described above, when the user manipulates the manipulation knob 710 in a state where the mixed gas discharged through the flame holes 231 of the outer burner 230 is combusted, the mixed gas is supplied to the inner burner 260 through the second mixing tube 271. Further, the mixed gas supplied to the inner burner 260 is discharged through the flame holes 261 of the inner burner 260.

Further, the mixed gas discharged through the flame holes 261 of the inner burner 260 is ignited by the flame formed by the mixed gas discharged through the flame holes 231 of the outer burner 230. In more detail, the flame formed by the combustion of the mixed gas discharged through the flame hole 231 of the outer burner 230 is transferred to the mixed gas discharged through the flame holes 261 of the inner burner 260 through the flame transfer slit 257. At this point, the flame transfer slit 257 is shielded by the shield rib 283. Accordingly, even when the food contained in the container disposed on the top grid 290 overflows, the extinguishing of the flame transferred through the flame transfer slit 257 can be prevented.

Meanwhile, the container disposed on the top grid 290 is heated by the flame formed by the ignition of the mixed gas discharged through the flame holes 231 of the outer burner 230 and the flame holes 261 of the inner burner 260. At this point, the air flowing along the first to third fluid passages P1, P2, and P3 is supplied to the inner burner 260 and thus the combustion of the mixed gas in the inner burner 260 can be more effectively realized.

Meanwhile, in the above-described simmer and normal cooking modes, the soup of the food contained in the container may overflow. The overflowing soup flows down to the top surface of the outer burner 230, i.e., to the top surface of the outer burner cap 250 or to the top surface of the inner burner 260, i.e., to the top surface of the outer burner cap 250 along the top surface of the inner burner cap 280. However, in this embodiment, the inflow preventing step 256 is provided on the top surface of the outer burner cap 250. Therefore, a phenomenon where the overflowing soup disturbs the flow of the air supplied to the inner burner 260 through the first to third fluid passages P1, P2, and P3 or the discharge of the mixed gas through the flame holes 261 of the inner burner can be prevented.

Furthermore, since the flame transfer slit 257 is shielded by the shielding rib 283, a phenomenon where the overflowing soup is introduced through the flame transfer slit 257 even when the soup of the food contained in the container overflows. Therefore, the interference of the flame transfer to the inner burner 260 by the overflowing soup of the food can be prevented.

Mode for the Invention

The following will describe a top burner according to a second embodiment and a cooker having the top burner in detail with reference to the accompanying drawings.

Figure 4:
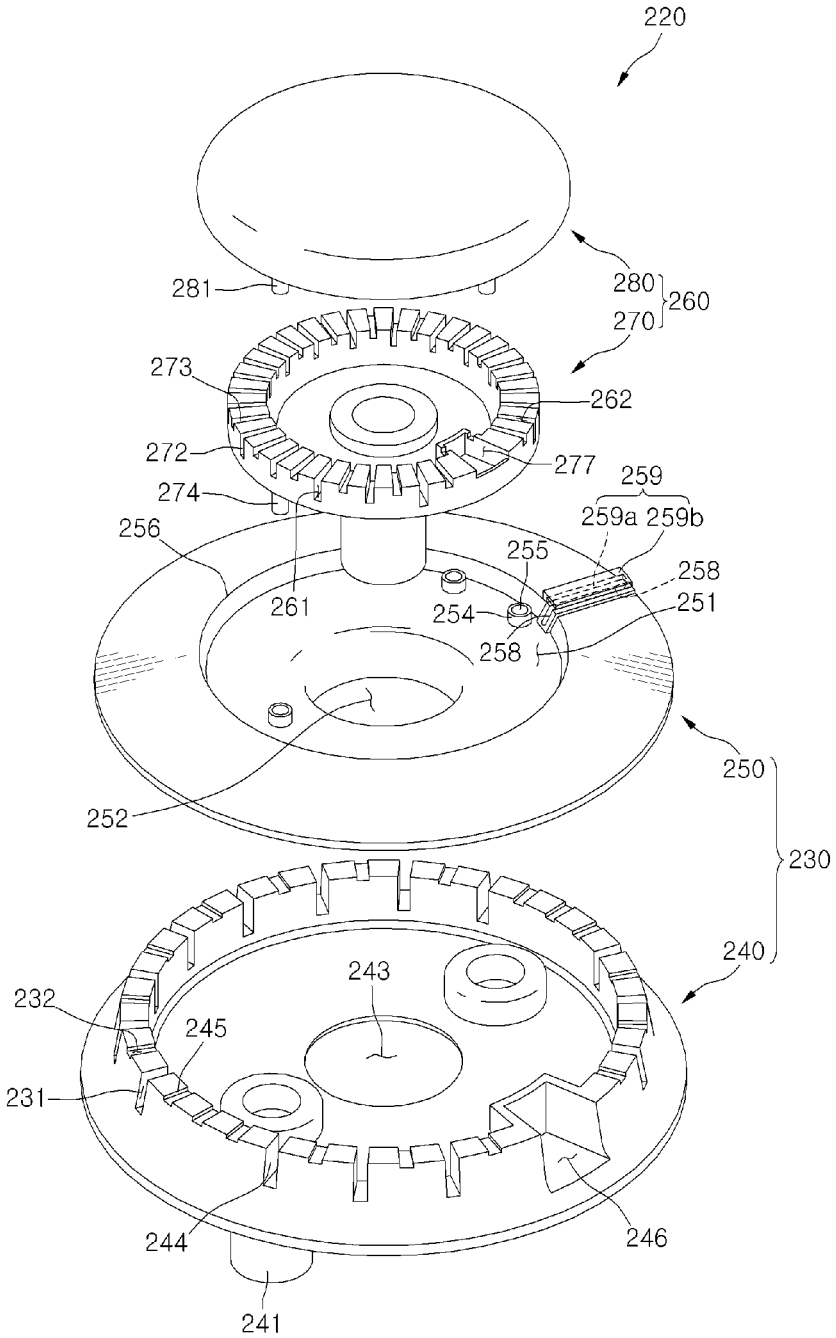
FIG. 4 is an exploded perspective view of a top burner according to a second embodiment.

FIG. 4 is an exploded perspective view of a top burner according to a second embodiment. In the first and second embodiments, like reference numbers will be used to refer to like parts that will not be described in detail.

Referring to FIG. 4, an outer burner cap 250 is provided with a flame transfer slit 257 for transferring flame formed by the combustion of the mixed gas discharged from main and sub-flame holes of the outer burner 230 to main and sub-flame holes 261 and 262 of an inner burner 260. The flame transfer slit 257 is substantially formed by partly cutting a portion of the top surface of the outer burner cap 250 in a radial direction.

A shielding member 259 is provided on a top surface of the outer burner cap 250 adjacent to the flame transfer slit 257. Like the shielding rib 283 of the first embodiment, a shielding member 259 is for preventing a phenomenon where the flame is extinguished transferred through the flame transfer slit 257 by overflowing soup of the food contained in the container during the cooking using the burner 220.

The shielding member 259 includes an extending portion 259A extending upward from the top surface of the outer burner cap 250 and a shielding portion 259B provided on a front end of the extending portion 259*a* and located above the flame transfer slit 257. Therefore, the phenomenon where the overflowing soup flows to the flame transfer slit 257 can be prevented by the shielding portion 259B. A vertically oblique portion of the shielding portion 259B may be formed to fully shield the flame transfer slit 257.

The following will describe a top burner according to a third embodiment and a cooker having the top burner in detail with reference to the accompanying drawings.

Figure 5:
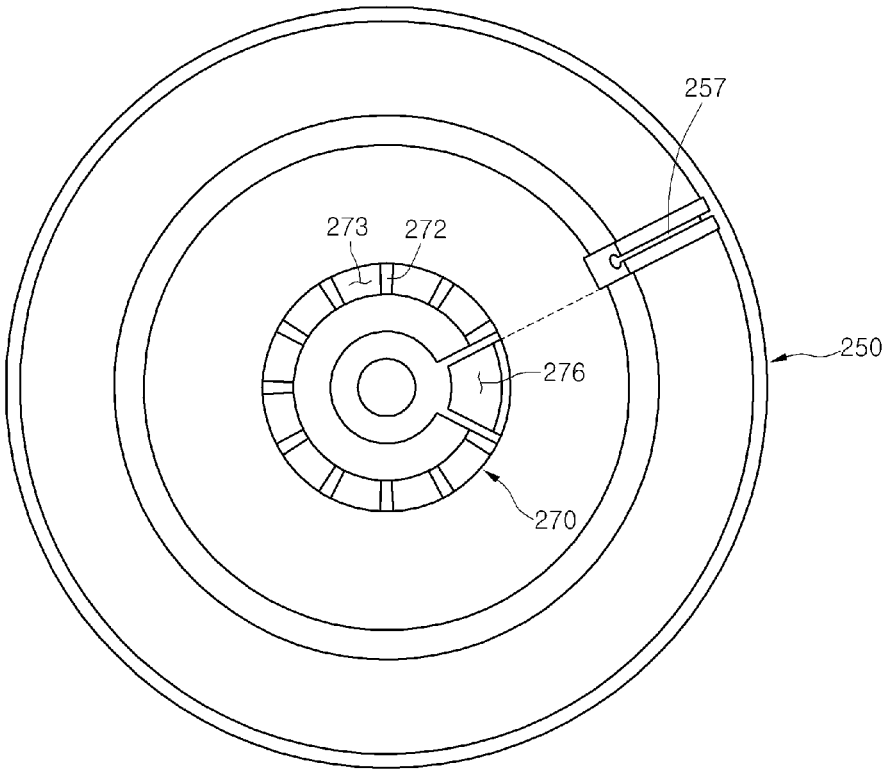
FIG. 5 is a top-plane view of a top burner according to a third embodiment.

FIG. 5 is a top-plane view of a top burner according to a third embodiment. In the first and third embodiments, like reference numbers will be used to refer to like parts that will not be described in detail.

Referring to FIG. 5, in this embodiment, a flame transfer slit 257 and a gas chamber 276 are disposed at an angle less than a predetermined angle. In more detail, an angle between an imaginary line extending in a length direction of the flame transfer slit 257 extending in a radial direction and an imaginary line extending from a side surface of the gas chamber 276 extending in the radial direction from the inner burner head 270 is 10° or less. Preferably, the imaginary line extending in a length direction of the flame transfer slit 257 extending in a radial direction and the imaginary line extending from a side surface of the gas chamber 276 extending in the radial direction from the inner burner head 270 are coaxially located. This is because that an amount of the carbon monoxide generated during the combustion of the mixed gas in the outer and inner burners 230 and 260 varies in accordance with the angle between the flame transfer slit 257 and the gas chamber 276. Referring to the following table 1, it can be clearly noted that an amount of the carbon monoxide generated in accordance with the angle between the flame transfer slit 257 and the gas chamber 276.

TABLE 1

| Angle between flame transfer slit and gas chamber (°) | Amount of monoxide (CO) (ppm at 20% of Oxygen ($0_2$)) |
|---|---|
| 90 | 237 |
| 45 | 214 |
| 25 | 156 |
| 10 | 76 |
| 0 | 28 |

That is, as shown in Table 1, it can be noted that, when the angle between the flame transfer slit 257 and one side of the gas chamber 276 is 10° or less, particularly, when the flame transfer slit 257 and the one side of the gas chamber 276 are coaxially disposed, the amount of the carbon monoxide generated during the combustion of the mixed gas in the outer and inner burners 230 and 260 is remarkably reduced.

Various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

For example, in the first to third embodiments, only one flame transfer slit is formed on the top surface of the outer burner head. However, the present invention is not limited to this. However, when the number of the flame transfer slits increases, the number of the shielding ribs and shielding members will correspondingly increase.

INDUSTRIAL APPLICABILITY

According to the above-described top burner and the cooker having the top burner of the present invention, the following effects are expected.

First, an edge of the container containing food is heated by the outer burner and a central portion of the container is heated by the inner burner. Therefore, the food can be more effectively cooked.

Further, since only the outer burner is used in the simmer mode for heating the food at a low temperature, an area of the container that is heated is relatively higher than a case where the inner burner is used. Therefore, the phenomenon where the food is burnt in the simmer mode can be minimized and thus the user can more conveniently cook the food.

Furthermore, the phenomenon where the overflowing soup from the container during the cooking is transferred to the flame transfer slit can be prevented by the shielding member. Therefore, the flame of the outer burner can be more accurately transferred to the inner burner and thus the operational reliability of the product can be improved.

The invention claimed is:

1. A top burner comprising:

a first burner provided with a plurality of flame holes that form flame by combusting mixed gas;

a second burner provided with a plurality of flame holes that form flame separated from the flame formed by the flame holes of the first burner by combusting the mixed gas;

a flame transfer slit transferring the flame formed through the flame holes of the first burner to the flame holes of the second burner;

a first gas chamber formed on an inside of the second burner; and a second gas chamber disposed at a side of the flame holes of the second burner to store mixed gas supplied to the second burner and combusted, wherein the flame transfer slit and the second gas chamber are located such that an angle between a line extending in a length direction of the flame transfer slit and one side of the second gas chamber is less than 10 degrees.

2. The top burner according to claim 1, wherein the flame transfer slit is formed by partly cutting a top surface of the first burner.

3. The top burner according to claim 1, wherein the first burner comprises:

a first burner head provided with a plurality of flame hole forming teeth; and a first burner cap provided on a top surface of the first burner head and provided with the flame transfer slit.

4. The top burner according to claim 3, wherein the flame transfer slit extends in a radial direction such that opposite ends thereof are adjacent to the flame holes of the first burner and the flame holes of the second burner.

5. The top burner according to claim 3, wherein the flame transfer slit is formed by partly cutting a top surface of the first burner cap.

6. The top burner according to claim 1, further comprising a shielding member for shielding an upper side of the flame transfer slit.

7. The top burner according to claim 1, further comprising a shielding rib extending in a radial direction from an outer circumference of the second burner cap of the second burner and having a bottom surface spaced apart from the flame transfer slit in a vertical direction.

8. The top burner according to claim 1, further comprising:

an extending portion extending upward from a top surface of a first burner cap of the first burner; and a shielding portion provided on a front end of the extending portion and located above the flame transfer slit.

9. The top burner according to claim 1, wherein the second burner comprises:

a second burner head provided with a plurality of flame hole forming teeth, the first gas chamber and the second gas chamber; and a second burner cap provided on a top surface of the second burner head.

10. The top burner according to claim 9, wherein at least one side of the gas chamber extends in a radial direction from the second burner head.

11. The top burner according to claim 1, wherein the flame transfer slit and the second gas chamber are located such that an imaginary line extending in a length direction of the flame transfer slit and one side of the second gas chamber are coaxially located.

12. A top burner comprising:

an outer burner installed on a top surface of a top plate and provided at an edge thereof with a plurality of flame holes that form flame by combusting mixed gas;

an inner burner installed on a top surface of the outer burner and provided at an edge located at an inside of the edge of the outer burner with a plurality of flame holes that form flame by combusting the mixed gas;

a flame transfer slit that is provided on the outer burner to transfer the flame formed through the flame holes of the outer burner to the flame holes of the inner burner;

the inner burner having an inner burner cap; and a shielding rib extending in a radial direction from an outer circumference of the inner burner cap, the shielding rib having a bottom surface vertically spaced from the flame transfer slit.

13. The top burner according to claim 12, Wherein the outer burner comprises:

an outer burner head; and an outer burner cap provided on a top surface of the outer burner head, wherein the flame transfer slit extends in a radial direction such that opposite ends thereof are adjacent to the flame holes of the outer burner and the flame holes of the inner burner.

14. The top burner according to claim 12, further comprising a shielding member that is provided at a side of one of the outer and inner burners to shield an upper side of the flame transfer slit.

15. The top burner according to claim 14, wherein the shielding member comprises: an extending portion extending upward from a top surface of an outer burner cap of the outer burner;

and a shielding portion provided on a front end of the extending portion and located above the flame transfer slit.

16. The top burner according to claim 12, further comprising a shielding rib extending along the flame transfer slit at a location spaced apart from the flame transfer slit at a side of an outer burner cap of the outer burner.

17. The top burner according to claim 12, further comprising a gas chamber disposed at a side of the inner burner to store the mixed gas that is supplied to the inner burner and combusted.

18. The top burner according to claim 17, wherein the flame transfer slit and the gas chamber are located such that an imaginary line extending in a length direction of the flame transfer slit and one side of the gas chamber are colinear.

19. The top burner according to claim 17, wherein the flame transfer slit and the gas chamber are located such that an angle between an imaginary line extending in a length direction of the flame transfer slit and one side of the gas chamber is less than 10°.

20. The top burner according to claim 12, wherein the inner burner comprises:

an inner burner head having a gas chamber storing the mixed gas that is supplied to the inner burner and combusted; and an inner burner cap provided on a top surface of the inner burner head, wherein at least one side of the gas chamber extends in a radial direction from the inner burner head.

21. The top burner according to claim 20, wherein the gas chamber is located at a portion except for an edge of the inner burner head where the flame holes of the inner burner are formed.

22. The top burner according to claim 20, wherein the flame transfer slit and the gas chamber are located such that an imaginary line extending in a length direction of the flame transfer slit and one side of the gas chamber are coaxially located.

23. The top burner according to claim 20, wherein the flame transfer slit and the gas chamber are located such that an angle between an imaginary line extending in a length direction of the flame transfer slit and one side of the gas chamber is less than 10°.

* * * * *